United States Patent [19]

Woessner et al.

[11] 3,948,504

[45] Apr. 6, 1976

[54] METHOD AND APPARATUS FOR FORMING AND COLLATING PRINTED SIGNATURES

[75] Inventors: Richard Woessner; Herman A. Dreyer, both of York, Pa.

[73] Assignee: Motter Printing Press Co., York, Pa.

[22] Filed: Mar. 18, 1974

[21] Appl. No.: 452,361

[52] U.S. Cl. ..... 270/21; 270/41

[51] Int. Cl.[2] ..... B41F 13/56

[58] Field of Search ..... 270/4–20, 58, 270/54, 21, 41, 52; 271/64, 69, 198, 173, 271, 165

[56] References Cited

UNITED STATES PATENTS

| | | | |
|---|---|---|---|
| 1,843,441 | 2/1932 | Boyce | 270/7 |
| 2,308,804 | 1/1943 | Dager | 270/58 |
| 2,427,839 | 9/1947 | Davidson | 270/58 |
| 2,873,113 | 2/1959 | McWhorter | 270/55 |
| 3,175,821 | 3/1965 | Gibson | 270/58 |
| 3,204,502 | 9/1965 | Fuller | 83/76 |

*Primary Examiner*—Edgar S. Burr
*Assistant Examiner*—A. Heinz
*Attorney, Agent, or Firm*—Brumbaugh, Graves, Donohue & Raymond

[57] ABSTRACT

A system for forming and collating printed signatures is disclosed in which a plurality of web supply rolls feed a plurality of continuously operating presses. A rewinding mechanism is provided to form printed web rolls which may be stored until printing has been completed for the entire publication. Slitting apparatus is provided longitudinally to cut each printed web into a plurality of printed ribbons which are thereafter collated to form one or more composite signature ribbons. Folding apparatus continuously folds each signature ribbon longitudinally and the folded ribbons are cross associated to form a compound ribbon moving substantially parallel to the gathering conveyor. The compound ribbon is cut into individual signature sets which are conveyed to the gathering conveyor.

1 Claim, 3 Drawing Figures

METHOD AND APPARATUS FOR FORMING AND COLLATING PRINTED SIGNATURES

BACKGROUND OF THE INVENTION

The present invention relates to a method for printing and collating individual signatures to be assembled into a magazine or book, or the like. In particular the invention relates to a signature forming system including a method consisting of slitting a printed web into a plurality of individual ribbons, and collating and folding the ribbons and conveying the folded ribbons in a direction parallel to the signature conveyor for separation into individual signatures to be deposited on the conveyor.

Heretofore, signature printing and collating systems have been provided in which printing is applied to both sides of a sheet which is thereafter folded into a signature or section of a book or magazine. The folded signature is then placed in a hopper. Identical signatures are placed in the hopper and the hoppers are linearly arranged in accordance with the order of the signatures in the assembled volume. The signatures are removed one at a time from each successive hopper and placed on a moving conveyor. As the conveyor advances, signatures from successive hoppers are stacked for binding. The conveyor includes pins which project upwardly from the surface at predetermined intervals to push the stacks of signatures. This collating arrangement is slow and inefficient since it involves complicated folding equipment having excessive mechanical action. In addition, such prior types of collating systems usually require large press crews to keep the complex mechanical equipment operating, and are thus relatively expensive.

Other prior types of collating machines have provided a main signature conveyor and an plurality of short signature transfer conveyors associated with signature dispensers linearly arranged along the main conveyor. The transfer conveyors are generally horizontal but move in a direction perpendicular to the main conveyor. As the main conveyor advances from one dispenser to the next, successive signatures are delivered by the transfer conveyors and are stacked on each other. The major disadvantage to this method is that the collating conveyor pins accelerate the individual signatures at a very high rate. If the signature has not had time to settle, air beneath the signature may cause it to plane, with the result that it may leave the conveyor or double back into the next section. In such systems, the signatures have been known to become disarrayed so that extensive jogging is required properly to orient the signatures. This increases the mechanical complexity of the apparatus, and hence the overall cost of the operation.

SUMMARY OF THE INVENTION

The present invention provides for a web binding system which includes a plurality of web supply rolls, each of which feeds a continuously operating press. The printed webs are rewound and stored until the printing is complete for the entire volume. The printed webs are thereafter slit into a plurality of web ribbons having a width corresponding to the width of unfolded signatures for the volume to be published. The ribbons are superimposed in a predetermined order to form at least one unfolded signature ribbon which is folded longitudinally and repeatedly cut to form signatures.

Signature ribbons may be superimposed before being cut, depending upon the nature of the signatures required. Discrete signatures are conveyed to the signature gathering conveyor by a transfer conveyor which runs parallel to and substantially at the same speed as the gathering conveyor.

BRIEF DESCRIPTION OF THE DRAWINGS

For a further understanding of the present invention, reference may be had to the accompanying drawings, in which.

BRIEF DESCRIPTION OF THE PREFERRED EMBODIMENTS

Figure 1:
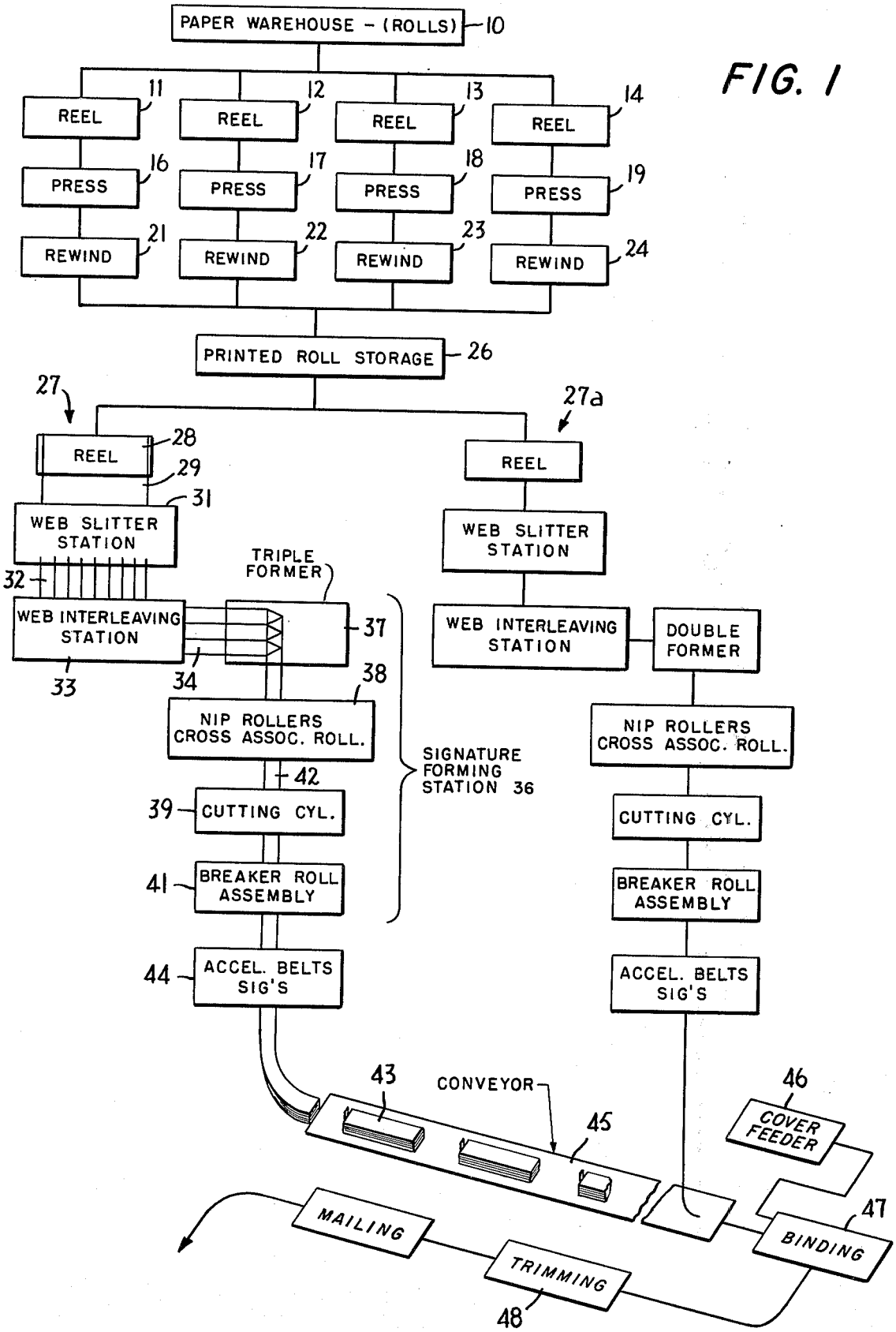
FIG. 1 is a flow diagram in block form depicting the operational sequence performed to supply and collate printed signatures in accordance with the present invention.

Referring now to the drawings, and in particular to FIG. 1, the present signature forming system includes a supply 10 of unprinted web supply rolls which may be manually or automatically transported to any of a plurality of web splicing rollstands 11 through 14. Each of the rollstands supplies a continuously running web to a respective printing press 16–19. Where desired, the unprinted supply rolls may be transported to the rollstands by automated dollies on tracks. The presses 16–19 may be of any known type, for example gravure, letterpress or offset.

In the embodiment illustrated, the web, after being printed, is fed off of the presses and into rewinding mechanisms 21–24, each of which is associated with one of the presses. As it is completed, each rewound roll may thereafter be removed to printed roll storage 26 to await completion of the remaining rolls required for a particular book or magazine.

When all of the rewound rolls for a particular publication have been printed and assembled in the roll storage area 26, each of the rolls is transported to one of a plurality of web collating stations generally indicated by reference numerals 27 and 27*a*. As with the transport of unprinted rolls from the supply area 10, the printed rolls may be moved to the web collating station either manually or by means of a suitable automatic transport mechanism. The total number of reels and web collating stations utilized depends upon the nature and requirements of the publication to be assembled. The structure and operation of each of the collating stations is essentially the same, so that only the collating station 27 will be described herein in detail.

As illustrated in FIG. 1, a printed roll 28 is adapted to feed a continuously running web 29 to a web slitter station 31. At the web slitter station, the web 29 is divided longitudinally into a plurality of ribbons 32, each of which has a width corresponding to the untrimmed width or double width of the publication to be assembled.

It should be noted, that slitting of the web may be accomplished at the rewind stations 21–24. The rewinders may be provided with a slitting device to slit the web into a plurality of ribbons when it is being rewound after coming off the presses. The ribbons may thereafter be fed into a gathering mechanism which collates them one on top of the other.

In the preferred embodiment, the ribbons 32 are drawn into a web interleaving station or angle bar section 33. At the angle bar section the individual ribbons 32 are superimposed to form one or a plurality of collated ribbons, as desired, each of which corresponds to an unfolded signature for the publication. The number of signature ribbons collated in the angle bar section 33 depends upon the nature of the publication to be bound. In the example illustrated in FIG. 1, the angle bar section is employed to form three collated signature ribbons. It is a major advantage of the invention that special sections, such as colored inserts or the like, can easily be fed through the angle bar section and automatically collated with other printed ribbons which make up a particular publication.

The collated signature ribbons 34 are thereafter drawn into a signature forming station 36. The signature forming station includes a plurality of fold producing formers 37, one for each of the signature ribbons. A plurality of cross association rollers 38 are provided to manipulate the folded signature ribbons as each comes off respective formers 37. Cutting means, such as a rotating cutting cylinder, illustrated schematically in FIG. 1 by reference numeral 39, acts to cut the folded signature ribbons sequentially into individual signatures or signature sets 43. A breaker roll assembly 41, pulls the signature sets 43 away from the cutting cylinders and feeds them into a pair of transfer conveyor belts, schematically illustrated in FIG. 1 by reference numeral 44, which serve to deposit the signature sets onto a main signature conveyor belt 45.

Each of the web collating stations 27 and 27*a* acts in substantially the same way to supply signature sets to the conveyor belt 45. The alignment of the transfer conveyors is such that signatures are deposited from the stations 27 and 27a, one on top of the other, on the main conveyor belt 45.

Depending upon the nature of the binding operation employed for the particular publication being collated, assembled signatures are conveyed by the belt 45 to a conventional stitcher for side stitching, for example, and hence to a binder. The cover for the publication is applied in the binder. An additional binder may also be employed where the capacity of one binder is exceeded by the speed of the conveyor 45.

Figure 2:
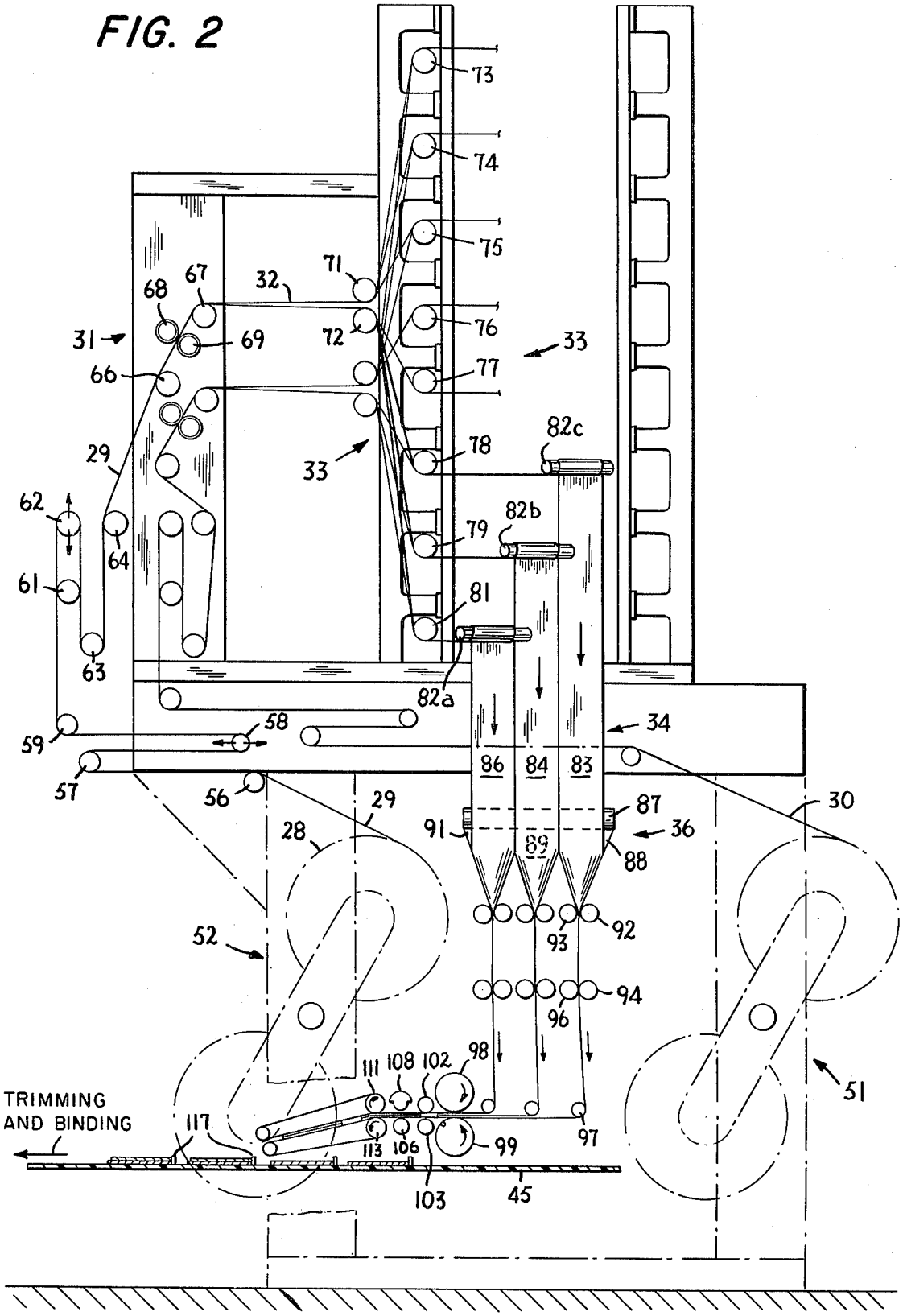
FIG. 2 is a cross sectional schematic representation of the web slitting and collating apparatus according to the invention.

With reference to FIG. 2, the printed rewound rolls, such as the roll 28, are removed from the printed roll storage area 26, and placed on one or more paster reel assemblies, indicated in broken lines, and generally by reference numerals 51 and 52. The paster reel assembly provides a continuously running feed web, such as the webs 29 and 30.

As described above, the web 29 runs from the roll 28 into the collating station 27. The structural details of each of the collating station are substantially identical, and each of the webs is handled in a substantially identical way. Thus, the following detailed description of a typical collating station will be based upon the path of the web 29, it being understood that except where otherwise noted the description as to other webs is the same.

The web 29, is fed from the running web supply roll 28 and passes over a plurality of draw and compensator pulleys 56–64. By way of example, the pulleys 58 and 62 may be of the dancing or floating type, generally movable back and forth substantially in the direction indicated by the arrows in FIG. 2. Such pulleys function in a known manner to control the tension in the web 29. The remaining pulleys serve to guide the running web away from the paster reel assembly 52 and into the web slitter and angle bar sections 31 and 33, respectively.

In the preferred embodiment, the web slitter station 31 includes a pair of spaced rollers 66 and 67. A plurality of sharp circular knives or slitters 68 may be positioned between the rollers 66 and 67 to cut the web 29 longitudinally into the reguisite number requisite ribbons 32. Suitable support for the cutting operation may be provided to the web from below by appropriate rollers 69.

The ribbons 32 are thereafter threaded between guide rollers 71 and 72, at which point the ribbons diverge, each individual ribbon thereafter passing over a suitable guide roller 73–81 respectively, and hence into the angle bar section 33.

The angle bar section contains a plurality of linear bars, such as the bars 82*a*, 82*b*, and 82*c*. Each of the bars is associated with one of the ribbons, and is positioned in the path of the ribbon to deflect its direction of travel. For simplicity, only the bars 82*a*, 82*b*, and 82*c* are shown in FIG. 2, it being understood that the other bars are substantially the same. The bars are oblique to the direction of travel of their respective web ribbons. By way of example, each of the bars 82*a*, 82*b*, and 82*c* are set at an angle of 45° to the direction of travel of the ribbons coming off of the rollers 81, 79, and 78 respectively. The bars are movably mounted to slide back and forth in a horizontal plane with respect to the rollers 78–81. The position of each of the bars relative to its respective roller determines the location of the ribbon after passing over the bar.

The bars serve to change the direction of travel of the ribbons by 90°. For example, with reference to FIG. 2, the ribbon passing around the roller 81 is deflected by the bar 82*a* to move in a direction perpendicular to and into the drawing. The ribbon is thereafter deflected downwardly toward the fold forming apparatus, as indicated, by suitable guide rollers (not shown).

In the embodiment illustrated, the bars for each of the ribbons 32 are selectively positioned with respect to the fixed guide rollers, such as the roller 81, so that predetermined ones of the ribbons are deflected to be superimposed to form three composite signature ribbons 83–86 preferably arranged side-by-side as shown. The number of composite signature ribbons may vary depending upon the nature of the publication to be bound.

Figure 3:
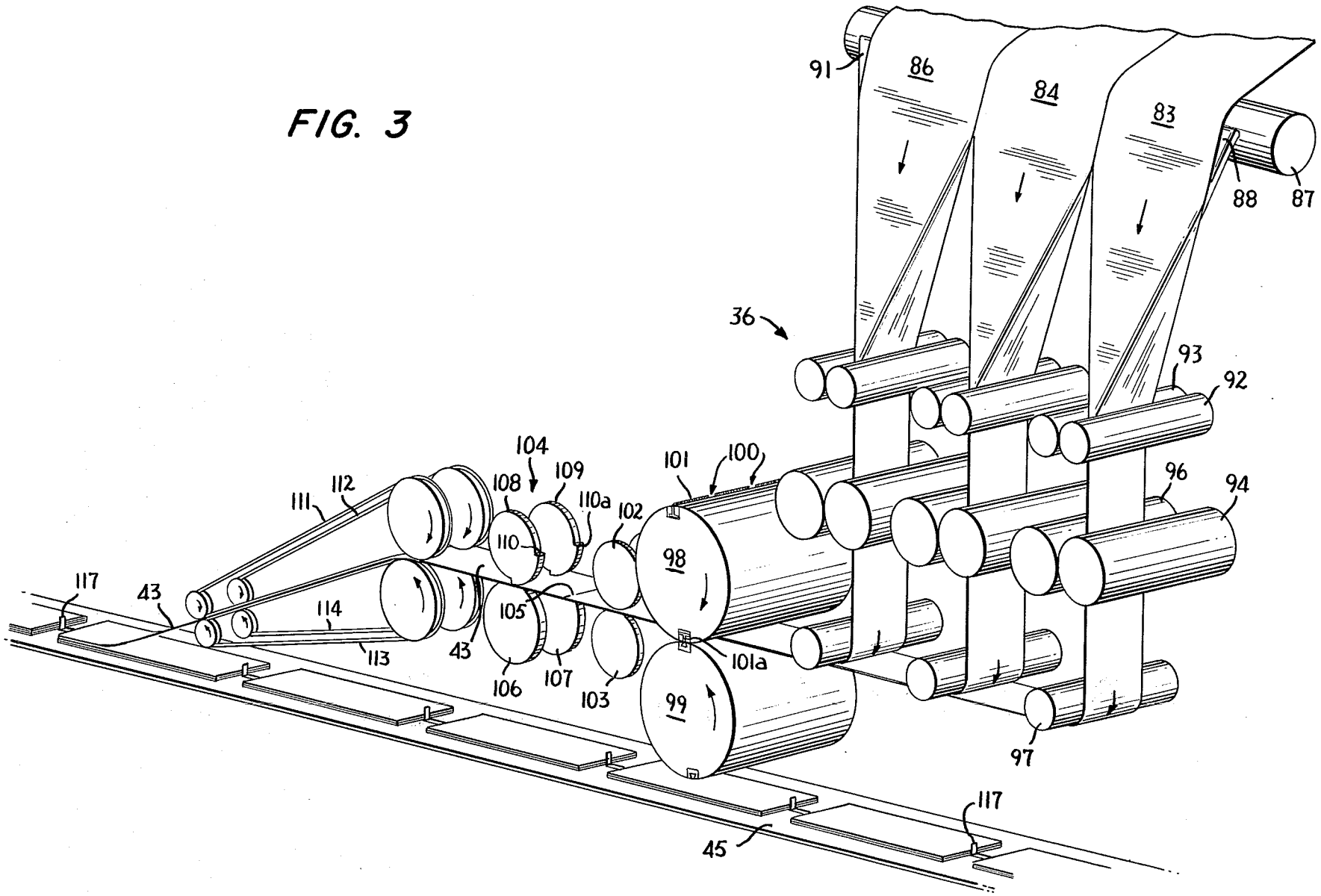
FIG. 3 is an enlarged schematic representation in perspective, of a portion of the signature forming and collating apparatus utilized in the system of the present invention.

With reference to FIGS. 2 and 3, each of the composite ribbons passes over a guide roller 87 and across one of a plurality of former boards 88–91. There is one former board for each of the composite ribbons 83–86. A pair of closely spaced guide rollers 92 and 93 is positioned adjacent the end of each of the former boards. The ribbon passes between the guide rollers as it comes off of the former board. The result is that each of the moving composite ribbons is folded along its central longitudinal axis. Each of the ribbons then passes between a pair of nip rollers 94 and 96 which pinch the ribbon to set the folded spine. Thus, the composite ribbons are turned 90° from a substantially coplanar, to a spaced parallel orientation. The ribbons are, accordingly, once again in position to be superimposed.

A plurality of cross association rollers 97 are provided across the path of movement of the folded ribbons. Each of the ribbons passes over one of the cross association rollers and is thereby deflected around the roller to run laterally substantially perpendicular to its direction of flow prior to passing around the roller 97. The arrangement of the rollers 97 is such that each of the folded composite ribbons is deflected to run in substantially the same direction. The ribbons are thereby superimposed one on top of the other to form a compound signature ribbon with the folded spine portions of each of the individual signature ribbons being aligned on the same side.

The compound ribbon thereafter passes between a pair of male and female cutter cylinders or rollers 98 and 99, respectively. The cutting rollers may be of a type generally known to those skilled in the art. By way of example, the male cutting roller 98 may be provided with a pair of diametrically opposed protruding cutting edges 101 and 101*a* adapted to sever the compound signature ribbon twice upon each rotation of the roller. The diameter of the roller is selected so that signatures of the proper length are formed each time the running folded ribbons are cut.

In the preferred embodiment, each of the cutting edges 101 and 101*a* is provided with wasted sections 100. The wasted sections of the cutting edges leave small uncut portions 105 of the compound signature ribbon as it passes through the cutting rollers.

A pair of nip rollers 102 and 103 are arranged simultaneously to grip the partially severed compound ribbon from above and below as it passes from between the cutting rollers. Thus, the partially severed leading signatures act to pull the trailing signatures away from the cutting cylinders.

The breaker roll assembly 41 preferably consists of a pair of interconncted coaxial lower rollers 106 and 107, each of which engages the undersurface of the signatures. A pair of interconncted coaxial wasted wheels 108 and 109, having similar lobe portions 110 and 110*a*, are rotatably positioned above the signatures. The wasted wheels act periodically to engage simultaneously the upper surface of the signatures with the lobe portions to press the signatures against the lower rollers 106 and 107. The signatures are thereby pulled ahead. This action snaps the uncut portions 105 and the signatures are thereby accelerated with respect to the next set of signatures still only partially severed from the ribbon. The signatures are thereby separted sufficiently to provide spacing between them on the main conveyor.

A plurality of endless drive belts 111–114 may be provided adjacent the breaker roll assembly 104 to define a transfer conveyor to carry the severed signatures away for deposit on the signature gathering conveyor 45. By way of example, the four belts 111–114 are arranged side by side both above and below the signatures. The upper belts 111 and 112 may be arranged directly above and adjacent the lower belts 113 and 114, respectively. A signature passing between the upper and lower corresponding pairs of the belts is thereby gripped between the belts and is transported along the belt interface raceway.

In accordance with the invention, one end of the belt raceway is elevated above the other end, so that the conveying interface between the belts is oblique to the plane of the gathering conveyor 45. Signatures being transported by the belts 111–114 are carried toward and deposited on the gathering conveyor 45. The rotational speed of the transfer conveyor belts is substantially the same as the speed of the gathering conveyor. Thus, signatures being deposited on the moving conveyor 45 need not be accelerated by conveying pins 117 which push the signatures along and maintain alignment of the signatures as they are carried from one feeding station to another. The bulk signatures thereby conveyed onto the binding conveyor 45 avoid being air lifted off of the signature stack by the speed of the conveyor.

It will be understood that the web collating system according to the present invention is susceptible of various modifications, changes and adaptations as will occur to those skilled in the art. It is therefore intended that the scope of the present invention is not to be limited except as defined by the following claims.

We claim:

1. In a method for forming and collating printed signatures for deposit on a signature gathering conveyor moving at a predetermined substantially constant speed in a path of travel including printing on a moving web, slitting the moving web longitudinally into a plurality of moving slit webs, superposing the moving slit webs to form at least one collated ribbon and folding the collated ribbon longitudinally, the improvement which comprises rewinding a printed web after printing and before forming the collated ribbon, unwinding the web before forming the collated ribbon, feeding the folded and collated ribbon toward and in substantially the same direction as the direction of travel of the gathering conveyor, cutting the folded and collated ribbon transversely at spaced intervals while feeding the folded and collated ribbon in substantially the same direction of travel as the direction of travel of the gathering conveyor, said cutting step partially but not completely severing the ribbon to form a group of folded, interleaved cut signatures still partially joined to said ribbon and advancing the cut signatures following the cutting step at an accelerated rate approximating the speed of the moving gathering conveyor to separate the cut signatures from the ribbon and to deposit them gently in a registered position on the upper surface of the span of the gathering conveyor.

* * * * *